US008191379B2

(12) United States Patent
Wuesthoff et al.

(10) Patent No.: US 8,191,379 B2
(45) Date of Patent: Jun. 5, 2012

(54) REFRIGERATOR HAVING IMPROVED ICE ACCESS FEATURE

(75) Inventors: Edward P. Wuesthoff, San Antonio, TX (US); Dongning Wang, Qingdao (CN)

(73) Assignee: Haier America Refrigerators Company, Ltd, Camden, SC (US)

( * ) Notice: Subject to any disclaimer, the term of this patent is extended or adjusted under 35 U.S.C. 154(b) by 1003 days.

(21) Appl. No.: 12/027,034

(22) Filed: Feb. 6, 2008

(65) Prior Publication Data

US 2008/0272679 A1 Nov. 6, 2008

Related U.S. Application Data

(60) Provisional application No. 60/888,356, filed on Feb. 6, 2007.

(51) Int. Cl.
*F25C 5/18* (2006.01)

(52) U.S. Cl. ..... 62/344; 62/465; 312/404

(58) Field of Classification Search ..... 312/402, 312/404, 407, 407.1; 62/441, 443, 459, 457.5, 62/344, 382, 465
See application file for complete search history.

(56) References Cited

U.S. PATENT DOCUMENTS

| | | | | | |
|---|---|---|---|---|---|
| 721,860 | A * | 3/1903 | Carr | 312/244 |
| 2,711,944 | A * | 6/1955 | Meek et al. | 312/333 |
| 3,364,695 | A * | 1/1968 | Saunders et al. | 62/382 |
| 4,402,144 | A * | 9/1983 | Dumke | 34/192 |
| 4,788,832 | A * | 12/1988 | Aoki et al. | 62/382 |
| RE37,518 | E * | 1/2002 | Hardigg et al. | 16/438 |
| 2004/0178708 | A1 * | 9/2004 | O'Halloran et al. | 312/404 |
| 2005/0061021 | A1 * | 3/2005 | Uihlein et al. | 62/441 |
| 2006/0086129 | A1 * | 4/2006 | Anselmino et al. | 62/344 |
| 2006/0130514 | A1 * | 6/2006 | Kim | 62/446 |
| 2007/0035221 | A1 * | 2/2007 | Koo | 312/404 |

* cited by examiner

*Primary Examiner* — James O Hansen
*Assistant Examiner* — Matthew Ing
(74) *Attorney, Agent, or Firm* — Nelson Mullins Riley & Scarborough, LLP

(57) ABSTRACT

The present invention provides a refrigeration apparatus having improved access to ice comprising a freezer compartment, a slidable support occupying a portion of the freezer compartment and configured to open to an extended position, an ice bin moveable with the slidable support and occupying at least a portion of the slidable support, and a stationary ice maker attached to the freezer compartment and located above the portion of the slidable support, wherein when the slidable support is pulled opened to the extended position, access to the ice bin is unobstructed by the ice maker.

18 Claims, 5 Drawing Sheets

REFRIGERATOR HAVING IMPROVED ICE ACCESS FEATURE

CLAIM OF PRIORITY

The present application claims the benefit of the U.S. provisional application filed on Feb. 6, 2007 by Wuesthoff et al. for REFRIGERATOR HAVING IMPROVED ICE ACCESS FEATURE (Ser. No. 60/888,356), the entire disclosure of which is hereby incorporated by reference herein.

FIELD OF THE INVENTION

The present invention relates to refrigerators. More particularly, the present invention relates to a refrigerator constructed and arranged to facilitate access to ice by a user.

BACKGROUND OF THE INVENTION

Most refrigerators intended for household use include an ice maker and an ice bin, which generally both stores the ice and provides access to the ice. Depending on the configuration of the refrigerator and/or the placement of the ice maker, accessing or reaching the ice may be difficult. Also, the amount of ice that can be produced and stored at one time is limited by the size of the ice bin.

A number of refrigerators include an ice dispenser coupled to the ice bin that dispenses ice from the ice bin through a refrigerator door. Typically, the user operates the ice dispenser by pushing a drinking glass against a paddle or other lever. When the lever is depressed, ice is released directly from the ice bin into the glass. While this may simplify accessing the ice, retrieval of the ice is limited to the dispenser's speed (and the size of the glass). As a result, removal of large amounts of ice using the dispenser is difficult and time-consuming.

SUMMARY OF THE INVENTION

The present invention recognizes and addresses the foregoing considerations, and others, of prior art construction and methods.

In this regard, one embodiment of the present invention provides a refrigeration apparatus having improved access to ice comprising a freezer compartment, a slidable support occupying a portion of the freezer compartment and configured to open to an extended position, an ice bin moveable with the slidable support and occupying at least a portion of the slidable support, and a stationary ice maker attached to the freezer compartment and located above the portion of the slidable support, wherein when the slidable support is pulled opened to the extended position, access to the ice bin is unobstructed by the ice maker.

According to another embodiment, the present invention provides a refrigeration apparatus having an improved access to ice that comprises a freezer compartment defining an upper freezer area and a lower freezer area, a top support occupying a portion of the upper freezer area and configured to open to a top extended position, a bottom support occupying a portion of the bottom freezer area and configured to open to a bottom extended position, and a stationary ice maker located in the upper freezer area, attached to the freezer compartment, and configured to produce ice that falls into the top support, wherein when the top support is opened to the top extended position, access to the ice is unobstructed by the ice maker.

A further embodiment of the present invention provides a refrigerator having an improved access to ice that comprises a refrigerator compartment, a freezer compartment located adjacent the refrigerator compartment and defining an upper freezer area and a lower freezer area, a top support occupying a portion of the upper freezer area, a bottom support occupying a portion of the lower freezer area, and a dropdown segment included in the top support and capable of opening to create an aperture between the top support and the bottom support, wherein the ice placed on the top support may drop onto the bottom support through the aperture when the dropdown segment is open.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
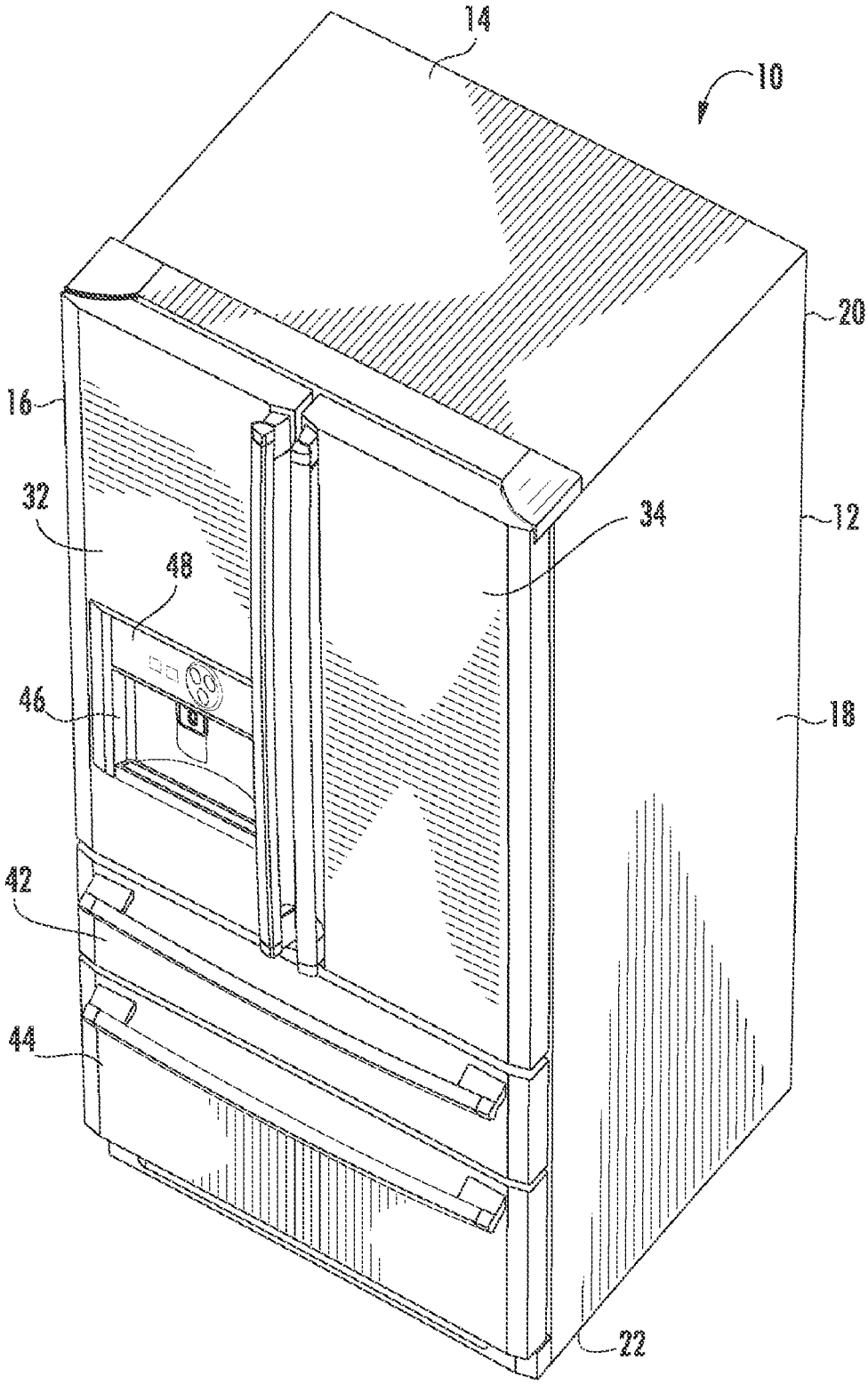
FIG. 1 is an isometric view of a refrigerator in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
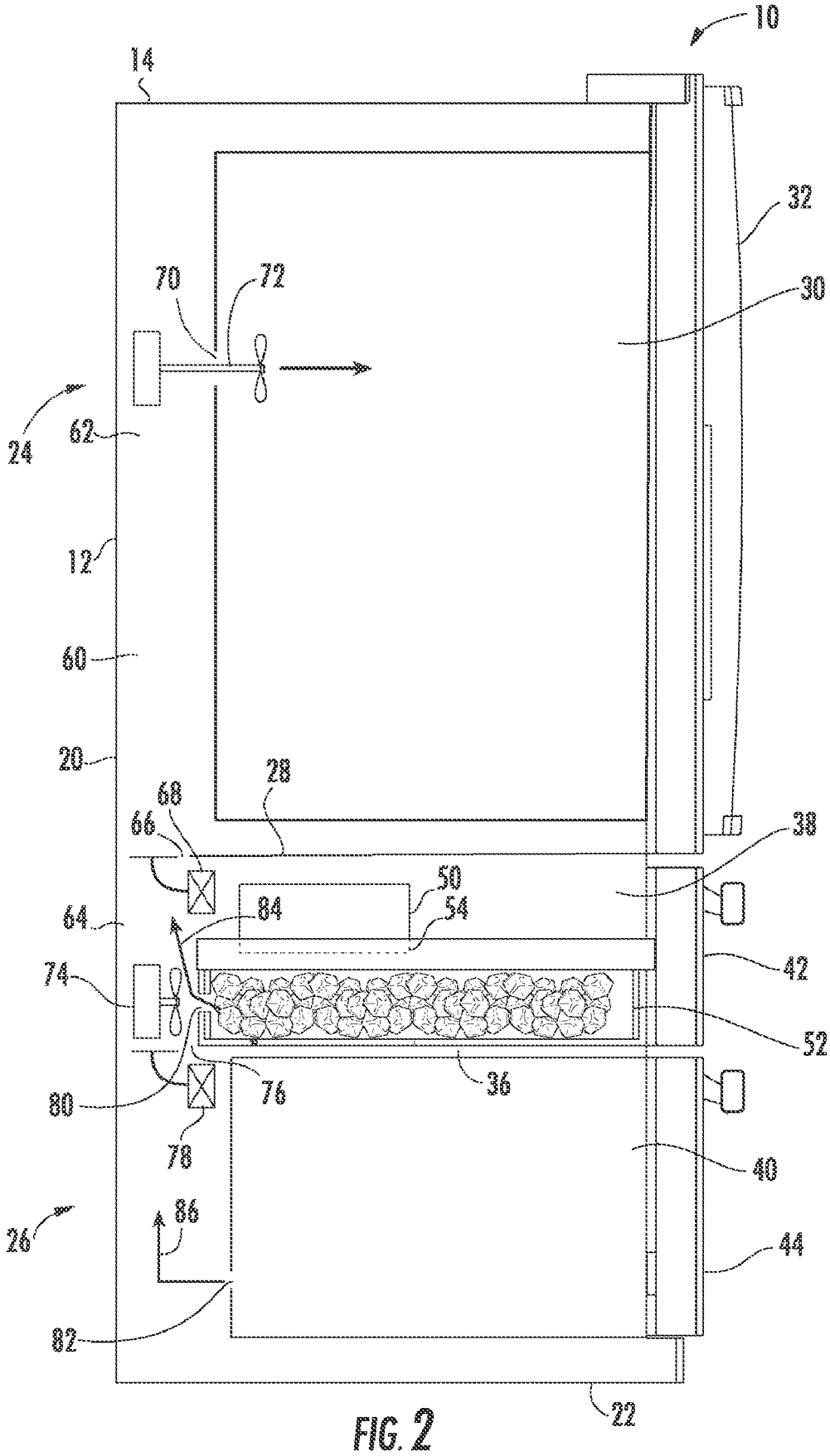
FIG. 2 is a left side diagrammatic view of the refrigerator of FIG. 1.

FIGS. 1 and 2 illustrate a refrigerator 10 constructed in accordance with an embodiment of the invention. Refrigerator 10 includes a housing 12 having a top wall 14, left wall 16, right wall 18, back wall 20, and bottom 22. As shown in FIG. 2, housing 12 defines an upper portion 24 and a lower portion 26 separated by an interior horizontal wall 28. Upper portion 24 includes a refrigeration compartment 30 enclosed by French doors 32 and 34. Lower portion 26 includes a freezer compartment 36 having an upper freezer area 38 and a lower freezer area 40. Top drawer 42 is slidably attached to housing 12 and occupies upper freezer area 38. Bottom drawer 44 is slidably attached to housing 12 and occupies lower freezer area 40. French door 32 includes dispenser 46 having a control panel 48. In the presently-described embodiment, a drawer front of top drawer 42 defines a portion of a front surface of refrigerator 10, and a drawer front of bottom drawer 44 defines another portion of the refrigerator's front surface.

Figure 3:
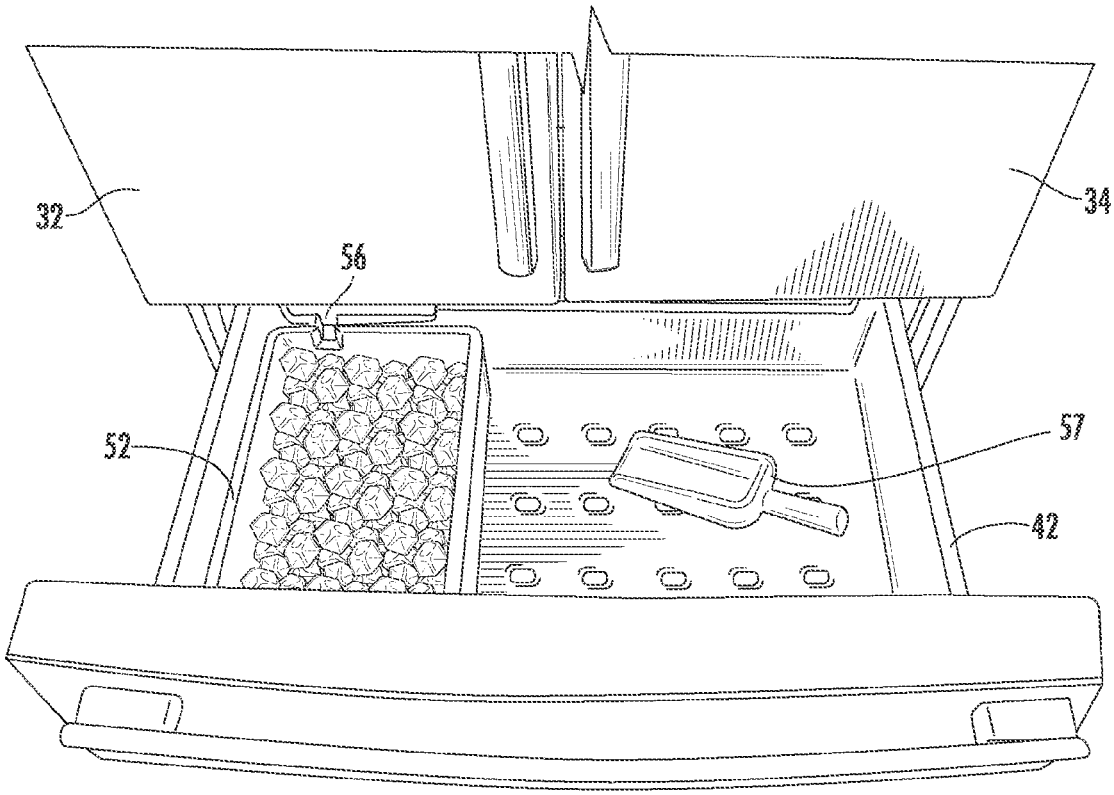
FIG. 3 is an enlarged isometric view showing an open top drawer of the refrigerator of FIG. 1.

Upper freezer area 38 includes an ice maker 50 attached to the underside of horizontal wall 28. In the illustrated embodiment, ice maker 50 is located in the upper left rear portion of upper freezer area 38. Referring to FIGS. 2 and 3, top drawer 42 includes a removable ice bin 52 that occupies a left portion of the drawer such that the ice bin is located directly underneath ice maker 50 when the drawer is closed. As indicated at 56, aligned indentations are defined in the rear portion of top drawer 42 and ice bin 52 to provide clearance for the bottom of ice maker 50 when drawer 42 is opened. An ice scoop 57 is preferably included in top drawer 42, as shown.

Figure 4:
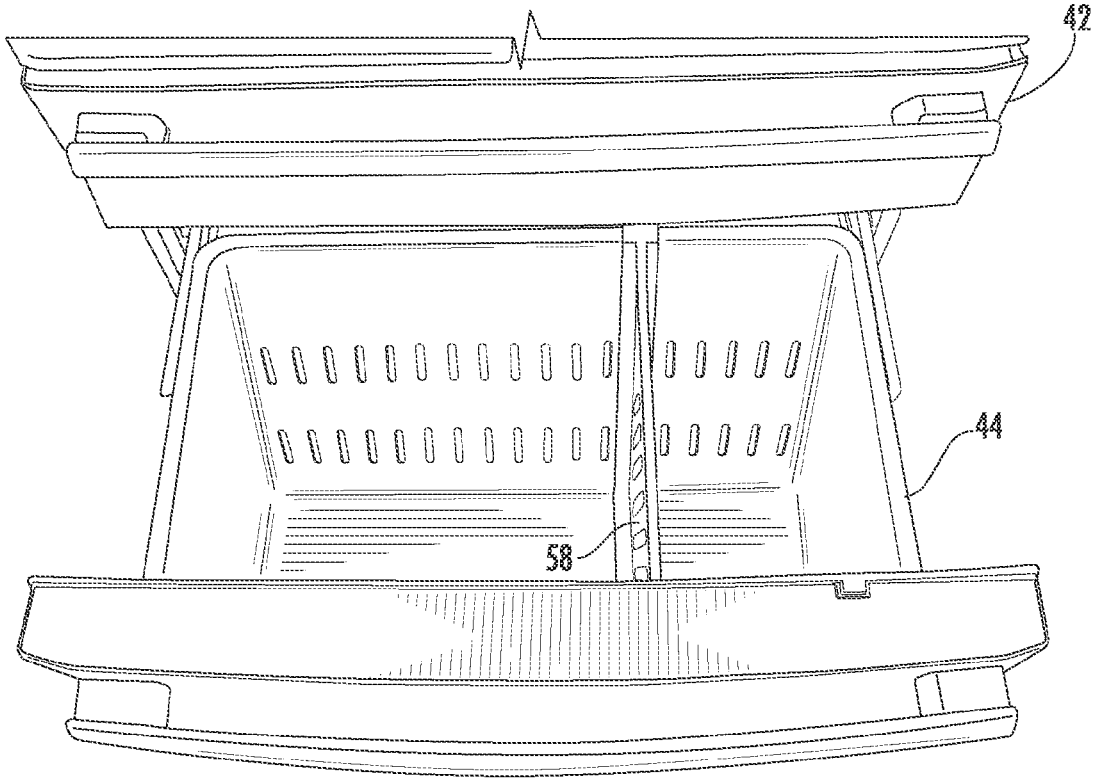
FIG. 4 is an enlarged isometric view showing an open bottom drawer of the refrigerator of FIG. 1.

Referring to FIGS. 1, 2, and 4, bottom drawer 44 is located directly underneath top drawer 42 and is proportionally deeper than the top drawer in order to allow storage of larger objects, such as frozen fowl. As shown, bottom drawer 44 preferably includes a removable divider 58 capable of sliding in the horizontal direction.

As shown in FIG. 2, a cooling area 60 is located at the rear of housing 12 along back wall 20 extending from top wall 14 to bottom 22 behind refrigeration compartment 30, upper freezer area 38, and lower freezer area 40. Cooling area 60 is divided by horizontal wall 28 into an upper cooling area 62 and a lower cooling area 64. Upper cooling area 62 occupies the space of upper portion 24 between back wall 20 and refrigeration compartment 30. Lower cooling area 64 occupies the space of lower portion 26 between back wall 20 and freezer compartment 36.

An air port 66 is defined in a rearward portion of horizontal wall 28 near back wall 20 to provide an air passage between upper cooling area 62 and lower cooling area 64. A damper 68 capable of opening and closing air port 66 is attached to the port. Another air port 70 is defined at the rear of refrigeration compartment 30 providing communication from upper cooling area 62 to the refrigeration compartment. Upper cooling area 62 includes a fan 72 that operates to pull cold air from the cooling area into refrigeration compartment 30 through port 70 and to circulate the air in the compartment. Lower cooling area 64 includes a fan 74 to circulate cold air through upper and lower freezer areas 38 and 40 from the lower cooling area. An air port 76 is defined in lower cooling area 64 between upper freezer area 38 and lower freezer area 40, which provides an air passage between the freezer areas. A damper 78 capable of opening and closing port 76 is attached to the port. Air ports 80 and 82 are defined at the rear of top drawer 42 and lower drawer 44, respectively, providing an air passage between lower cooling area 64 and the drawers.

In operation, a user is able to set the temperature of refrigeration compartment 30 and freezer compartment 36 to desired levels, respectively, by using control panel 46 (FIG. 1). It should be understood by one of ordinary skill in the art that control panel 46 may be placed in different locations, including inside refrigeration compartment 30, depending on the construction and arrangement of refrigerator 10. In another embodiment, the user is able to set the desired temperature level of upper freezer area 38 and lower freezer 40, separately.

Cool air is circulated through cooling area 60 by the refrigeration system of refrigerator 10. Temperature sensors within each area of refrigerator 10, such as refrigeration compartment 30, transmit temperature information to the refrigerator's control circuitry. The control circuitry instructs dampers 68 and 78 to adjust the amount ports 66 and 76 are opened or closed depending on the variance between the temperature of the corresponding area and the desired temperature for that area. Fans 72 and 74 circulate air throughout refrigeration compartment 30 and freezer compartment 36, respectively. Air leaving upper freezer area 38 and lower freezer area 40 is recirculated to the refrigeration system as denoted by arrows 84 and 86, respectively. Refrigeration systems of household refrigerators should be understood by one of ordinary skill in the art and are, therefore, not discussed in further detail.

Referring to FIGS. 2 and 3, when top drawer 42 is closed, ice produced by ice maker 50 falls into ice bin 52. Alternatively, a user may remove ice bin 52 allowing top drawer 42 to fill completely with ice produced by ice maker 50. When the amount of ice in ice bin 52 (or top drawer 42 if the bin is removed) reaches a certain height, ice maker 50 ceases to produce ice until ice has been removed from the bin (or the drawer) providing a sufficient space for more ice.

Referring again to FIG. 3, top drawer 42 may be fully extended to expose the drawer's contents. When opened, top drawer 42 provides a user with unobstructed access to ice bin 52 in its entirety and the ice stored therein. If ice bin 52 has been removed, top drawer 42 provides a user with unobstructed access to the ice stored in the entire drawer. The user can easily retrieve ice from top drawer 42 either by hand or by using ice scoop 57. As described above, ice maker 50 is fixedly attached to the underside of horizontal wall 28 so that when top drawer 42 is fully extended, the ice maker remains in upper freezer area 38, thereby preventing obstruction to the ice bin (or top drawer 42) by the ice maker. Indentations 56 allow top drawer 42 and ice bin 52 to slide past ice maker 50 without obstruction by or contact with the portion of the ice maker occupying space in the drawer (denoted in FIG. 2 by shadow lines 54) when the drawer is extended to an open position.

Figure 5:
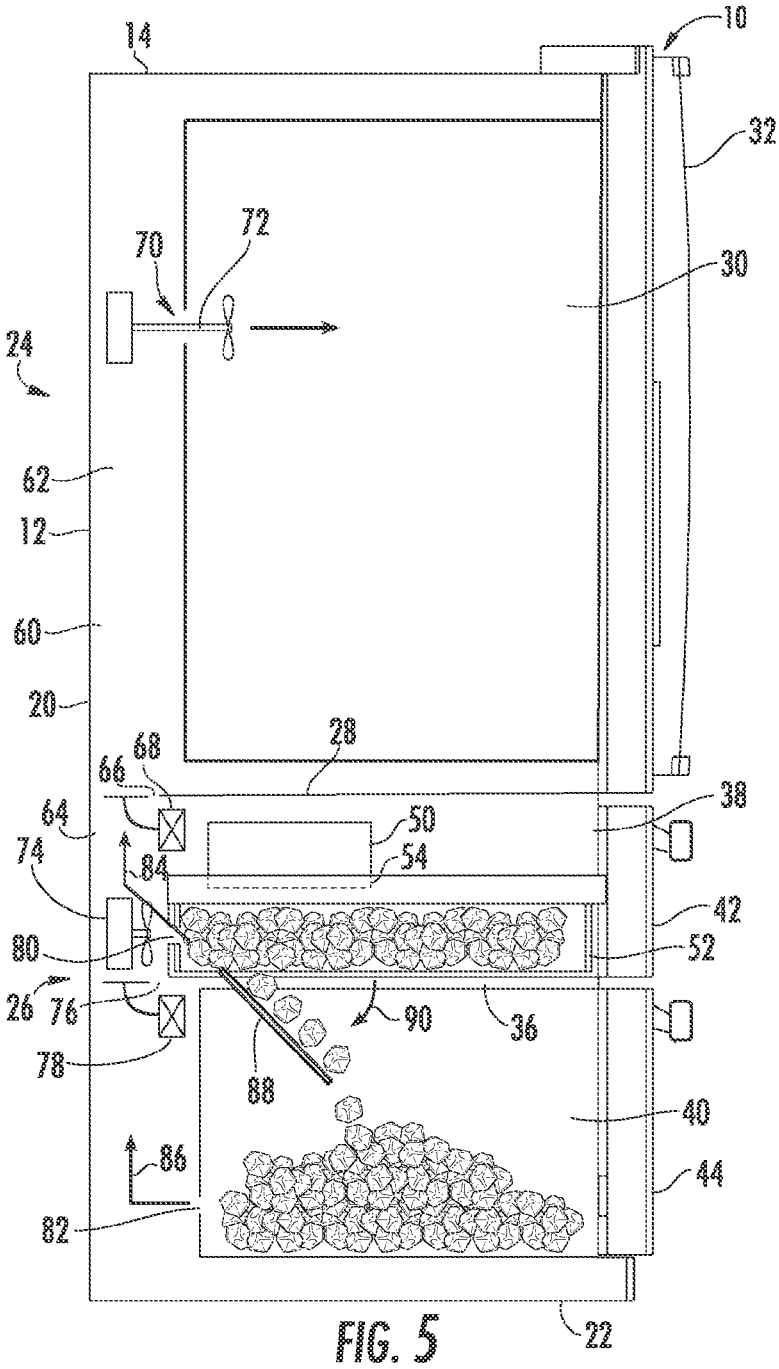
FIG. 5 is a left side diagrammatic view of a refrigerator in accordance with an alternate embodiment of the present invention.
Figure 6:
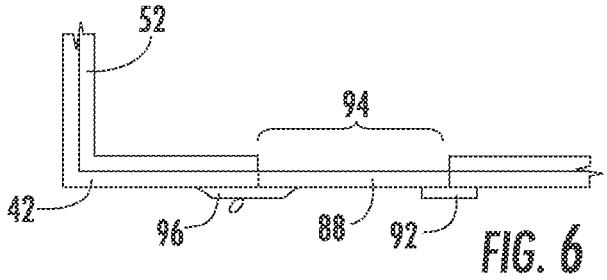
FIG. 6 is a left side sectional view of a portion of the top drawer of the refrigerator of FIG. 5 in accordance with an embodiment of the present invention.

In another embodiment and referring to FIGS. 5 and 6, a rectangular portion of ice bin 52 and top drawer 42 form a dropdown segment 88 capable of opening (denoted by arrow 90) to create an aperture between drawers 42 and 44. It should be understood to one of ordinary skill in the art that other devices may be substituted for segment 88 or that the segment may employ other manners of operation, such as a removable segment or one that slides laterally to create an aperture similar to the one described above. It should also be understood that various means of attaching segment 88 to top drawer 42 in order to keep the segment in the closed position, such as a latch or fastener (commonly denoted at 92 in FIG. 6), may be used without departing from the scope of the invention. In another embodiment, ice bin 52 defines a hole 94 located directly above dropdown segment 88 (FIG. 6).

In operation, opening segment 88 creates an aperture between top drawer 42 and bottom drawer 44. As a result, ice produced by ice maker 50 or ice stored in bin 52 drops into bottom drawer 44. This allows a much larger quantity of ice to be collected. Segment 88 can be opened either manually by the user or configured to open automatically when the weight of the ice above the segment reaches a certain weight. For example, segment 88 may include a torsion spring 96 or other suitable means to urge it normally into a closed position. In such an embodiment, the weight of the ice then pushes segment 88 open, allowing ice to drop into bottom drawer 44. Segment 88 can also be locked into place to prevent creating an aperture between drawers 42 and 44, thus preventing ice from dropping into bottom drawer 44 until the aperture is opened by a user.

Referring to FIG. 4, bottom drawer 44 may be fully extended to entirely expose the drawer's contents similar to top drawer 42 (FIG. 3). As described above, bottom drawer 44 preferably includes removable divider 58 capable of partitioning the drawer into separate sections. Accordingly, a user is able to separate bottom drawer 44 into sections and also change how the sections are divided. Divider 58 can also be removed to convert the separate sections of bottom drawer 44 into one undivided area.

When segment 88 (FIG. 5) is opened allowing ice to fall into bottom drawer 44, divider 58 allows the user to determine what portion of the bottom drawer is to be used to store the ice. Specifically, moving divider 58 to the left reduces the portion of bottom drawer 44 to be used to store ice. Conversely, moving divider 58 to the right enlarges the portion of bottom drawer 44 to be used to store ice. Alternatively, divider 58 may be removed to allow the entire space occupied by bottom drawer 44 to be used to store ice. The user can easily retrieve the ice from bottom drawer 44 by hand or by using ice scoop 57 (FIG. 3).

Referring to FIGS. 3, 4, and 5, once the section of bottom drawer 44 allocated to store ice by the user fills with ice, ice bin 52 (or top drawer 42 if the bin is removed) will then begin to fill with ice. When the amount of ice in ice bin 52 (or top drawer 42 if the bin is removed) reaches a certain height, ice maker 50 ceases to produce ice until ice has been removed either from bin 52, top drawer 42, or bottom drawer 44, thus providing a sufficient amount of space for more ice.

It should be understood to one of ordinary skill in the art that the above description provides a refrigerator user with improved, unobstructed access to ice located in the freezer compartment of a refrigerator. It also provides the user with the ability to alter the amount of space used to store ice. As described above with respect to FIGS. 2 and 3, ice produced by ice maker 50 is stored in ice bin 52 during normal operation. Ice bin 52 may be removed so that ice may be stored in the entire space enclosed by top drawer 42. As described above with respect to FIG. 5, segment 88 can be opened allowing ice produced by ice maker 50 to fall into bottom drawer 44. This allows the user to store additional ice for other uses requiring a greater amount of ice than normal use, such as social gatherings or to fill an external container with ice. The use of removable bin 52 (FIG. 3) and divider 58 (FIG. 4) allows the user to determine how much of freezer compartment 36 will be used to store ice, such that a maximum amount of ice can be stored when both the bin and divider are removed permitting drawers 42 and 44 to fill entirely with ice.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A refrigeration apparatus having improved access to ice, said apparatus comprising:

a freezer compartment;

a slidable support occupying a portion of said freezer compartment, said slidable support configured to open to an extended position, wherein a bottom surface of said slideable support defines an aperture, and wherein the slideable support includes a dropdown segment configured to selectably open and close said aperture;

an ice bin moveable with said slidable support, said ice bin occupying at least a portion of said slidable support, said ice bin defining a hole located above said dropdown segment;

a stationary ice maker attached to said freezer compartment, said ice maker located above said portion of said slidable support; and a drawer occupying another portion of said freezer compartment directly below said portion of said freezer compartment occupied by said slideable support, so that, when said ice bin is removed, said drawer fills with ice produced by said ice maker that falls through said aperture, wherein a rear portion of said slidable support defines a first indentation configured to provide a clearance for a portion of said ice maker that occupies space in an area defined by said slideable support whereby said portion of said ice maker passes through said first indentation when said slidable support is opened to said extended position so that access to said ice bin is unobstructed by said ice maker.

2. The refrigeration apparatus of claim 1 wherein a rear portion of said ice bin defining a second indentation configured to allow said clearance when said slidable support is opened to said extended position, wherein said second indentation being in register with said first indentation.

3. The refrigeration apparatus of claim 2 wherein said slidable support is incorporated into a drawer, wherein a drawer front of said drawer defines a portion of a front surface of the refrigeration apparatus.

4. The refrigeration apparatus of claim 3 wherein said ice bin is removable, such that when said ice bin is removed, said drawer fills with ice produced by said ice maker.

5. The refrigerator of claim 1 wherein said dropdown segment covers the aperture and is configured to open so that ice may fall from said slideable support into said drawer when said dropdown segment is open.

6. The refrigeration apparatus of claim 1, wherein said dropdown segment prevents ice from falling through said aperture when placed in a closed position.

7. A refrigeration apparatus having an improved access to ice, said apparatus comprising:

a freezer compartment defining an upper freezer area and a lower freezer area;

a top drawer occupying a portion of said upper freezer area, said top drawer configured to open to a top extended position, wherein a bottom surface of said top drawer defines an aperture, said top drawer includes a dropdown segment configured to selectably open and close said aperture, a portion of said top drawer is configured to receive a removable ice bin that, when placed in said top drawer, covers said aperture, and said ice bin includes a hole, such that said hole is located directly above said dropdown segment when said ice bin is placed in said drawer;

a bottom drawer occupying a portion of said bottom freezer area, said bottom drawer configured to open to a bottom extended position; and a stationary ice maker located in said upper freezer area and attached to said freezer compartment, said ice maker configured to produce ice that falls into said removable ice bin when said removable ice bin is placed in said top drawer, into said top drawer when said removable ice bin is removed, and into said bottom drawer when passing through said aperture.

8. The refrigeration apparatus of claim 7 further comprising:

a first indentation defined by a rear of said removable ice bin; and a second indentation defined by a rear of said top drawer, wherein said first indentation and said second indention provide a clearance of said ice maker to said top drawer when said top drawer is opened to said top extended position.

9. The refrigeration apparatus of claim 7 further comprising a torsion spring attached to said dropdown segment, wherein said torsion spring is biased to maintain said dropdown segment in a closed position.

10. The refrigeration apparatus of claim 7 further comprising closure means attached to said dropdown segment, wherein said closure means maintains said dropdown segment in a closed position.

11. The refrigeration apparatus of claim 7 further comprising a divider located in said bottom drawer, wherein said divider is capable of partitioning said bottom drawer into two sections.

12. The refrigeration apparatus of claim 7, wherein said dropdown segment prevents ice from falling through said aperture when placed in a closed position.

13. A refrigerator having an improved access to ice comprising:

a refrigerator compartment;

a freezer compartment located adjacent said refrigerator compartment, said freezer compartment defining an upper freezer area and a lower freezer area;

a top drawer occupying a portion of said upper freezer area;

a bottom drawer occupying a portion of said lower freezer area;

a dropdown segment included in said top drawer, said dropdown segment capable of opening to create an aperture between a top support area defined by said drawer and a bottom support area defined by said bottom drawer;

a removable ice bin moveable with said top drawer, said removable ice bin includes a hole, such that said hole is located above said dropdown segment; and a removable, slidable divider configured to be placed in said bottom drawer, such that said divider is capable of partitioning said bottom drawer into sections, wherein said ice bin and said divider are used to determine an amount of said top drawer and said bottom drawer to be used to store ice, and wherein ice placed in said top drawer may drop into said bottom drawer through said aperture when said dropdown segment is open.

14. The refrigerator of claim 13 further comprising an ice maker attached to said freezer compartment located in said upper freezer area, wherein when said top drawer is opened to an extended position, access to the ice is unobstructed by said ice maker.

15. The refrigerator of claim 13 wherein said dropdown segment is manually operated to create and remove said aperture.

16. The refrigerator of claim 13 wherein said dropdown segment opens automatically when the ice above said dropdown segment exhibits a specific weight.

17. The refrigerator of claim 16 wherein said specific weight is a weight sufficient to overcome a torsion spring attached to said dropdown segment.

18. The refrigerator of claim 13 further comprising a closure means attached to said dropdown segment, wherein said closure means maintains said dropdown segment in a closed position.

* * * * *